US009255338B2

(12) United States Patent
Prado

(10) Patent No.: US 9,255,338 B2
(45) Date of Patent: Feb. 9, 2016

(54) PERMANENT SYSTEM FOR CONTINUOUS DETECTION OF CURRENT DISTRIBUTION IN INTERCONNECTED ELECTROLYTIC CELLS

(75) Inventor: Felix Prado, Monzon (ES)

(73) Assignee: INDUSTRIE DE NORA S.P.A., Milan (IT)

( * ) Notice: Subject to any disclaimer, the term of this patent is extended or adjusted under 35 U.S.C. 154(b) by 161 days.

(21) Appl. No.: 14/342,903

(22) PCT Filed: Sep. 13, 2012

(86) PCT No.: PCT/EP2012/067970
§ 371 (c)(1),
(2), (4) Date: Mar. 5, 2014

(87) PCT Pub. No.: WO2013/037899
PCT Pub. Date: Mar. 21, 2013

(65) Prior Publication Data

US 2014/0209455 A1 Jul. 31, 2014

(30) Foreign Application Priority Data

Sep. 16, 2011 (IT) ..... MI2011A1668

(51) Int. Cl.

| | |
|---|---|
| ***C25C 7/06*** | (2006.01) |
| ***C25C 7/02*** | (2006.01) |
| ***C25C 3/16*** | (2006.01) |
| ***C25C 7/00*** | (2006.01) |

(52) U.S. Cl.
CPC ... *C25C 7/02* (2013.01); *C25C 3/16* (2013.01); *C25C 7/00* (2013.01); *C25C 7/06* (2013.01)

(58) Field of Classification Search
CPC ..... C25C 7/02; C25C 7/06; C25C 3/16
USPC ..... 204/228.9, 229.9, 297.01
See application file for complete search history.

(56) References Cited

U.S. PATENT DOCUMENTS

| | | | |
|---|---|---|---|
| 4,038,162 | A | 7/1977 | Kapanen |
| 2003/0066759 | A1 | 4/2003 | Hardee |

FOREIGN PATENT DOCUMENTS

| | | | |
|---|---|---|---|
| WO | 2009/016190 | 2/2009 | |
| WO | WO 2012020243 A1 * | 2/2012 | ..... C25C 7/00 |

OTHER PUBLICATIONS

International Search Report issued in PCT Application No. PCT/EP2012/067970.

* cited by examiner

*Primary Examiner* — Nicholas A Smith
(74) *Attorney, Agent, or Firm* — Lucas & Mercanti, LLP

(57) ABSTRACT

The invention relates to a current collecting bus-bar comprising electrode housings for accommodating a multiplicity of electrodes in electrical contact therewith. Probes for measuring the electric potential locally established in correspondence of the electrical contacts during the passage of electric current are also connected to the bus-bar. The invention further relates to a permanent monitoring system allowing the continuous evaluation of current distribution on each electrode of electrolysis cells of metal electrowinning or electrorefining plants, connected to an alerting system and to means for disconnecting individual electrodes in case on non-compliance with preset values.

11 Claims, 3 Drawing Sheets

PERMANENT SYSTEM FOR CONTINUOUS DETECTION OF CURRENT DISTRIBUTION IN INTERCONNECTED ELECTROLYTIC CELLS

This application is a U.S. national stage of PCT/EP2012/067970 filed on Sep. 13, 2012 which claims the benefit of priority from Italy Patent Application No. MI2011A001668 filed Sep. 16, 2011, the contents of each of which are incorporated herein by reference.

FIELD OF THE INVENTION

The present invention relates to a current collecting bus-bar comprising electrode housings for accommodating a multiplicity of electrodes in electrical contact therewith. Probes for measuring the electric potential locally established in correspondence of the electrical contacts during the passage of electric current are also connected to the bus-bar. The invention further relates to a permanent monitoring system allowing the continuous evaluation of current distribution on each electrode of electrolysis cells of metal electrowinning or electrorefining plants.

BACKGROUND OF THE INVENTION

Current supplied to cells of electrochemical plants, with particular reference to metal electrowinning or electrorefining plants, may be apportioned to the individual cell electrodes in a very diverse and inhomogeneous way, negatively affecting the production. This kind of phenomena can take place due to a number of different reasons. For instance, in the particular case of metal electrowinning or electrorefining plants, the negatively polarised electrodes (cathodes) are frequently withdrawn from their seats in order to allow harvesting the product deposited thereon, to be put back in place later on for a subsequent production cycle. This frequent handling, which is generally carried out on a very high number of cathodes, often brings about an imperfect repositioning on the bus-bars and far from perfect electrical contacts, also due to the possible formation of scales on the relevant seats. It is also possible that product deposition take place in an irregular fashion on the electrode, with formation of product mass gradients altering the profile of cathode surfaces. When this occurs, a condition of electrical disequilibrium is established due to the anode-to-cathode gap which in fact is not constant anymore along the whole surface: the electrical resistance, which is a function of the gap between each anode-cathode pair, becomes variable worsening the problem of unevenness in current distribution.

Current can thus be apportioned to each electrode in different amounts, both due to bad electrical contacts of the electrodes themselves with the current collecting bus-bars and to the alteration of the cathode surface profile. Moreover, even the simple anode wear may affect current distribution.

These inhomogeneities in current distribution can lead to anode-cathode short-circuiting phenomena. In the event of a short-circuiting, current tends to concentrate on the short-circuited cathode subtracting current to the remaining cathodes and seriously hampering production, which cannot be restored before the short-circuited cathode is disconnected from the cell.

Furthermore, an irregular current distribution, besides provoking a loss in quality and production capacity as mentioned above, would challenge the integrity and lifetime of anodes of modern conception manufactured out of titanium meshes.

In industrial plants, given the high number of cells and electrodes that are present, the task of spotting irregularities in current distribution is a very complex one. Such a detection involves in fact thousands of manual measurements, carried out by operators by means of infrared or magnetic detectors. In the specific case of metal electrowinning or electrorefining plants, operators execute such detections in a very warm environment and in the presence of acid mists, mainly containing sulphuric acid.

Moreover, conventional manual elements used by operators, such as gaussmeters or instruments with infrared sensors, allow locating only big current distribution disequilibria, since what they really detect are unbalances associated with magnetic field or temperature variations.

These manual or semi-manual systems have the disadvantage of not working in continuous, only allowing to execute occasional checks, besides being very expensive.

There are known wireless systems for cell monitoring that, although being permanent and operating in continuous, can only detect voltage and temperature variations for each cell and not for each single electrode. For the above explained reasons, this information is scarcely accurate and globally insufficient. Moreover, there are developmental projects aiming at the continuous detection of current supplied to individual cathodes by fixed current sensors relying on Hall effect: such sensors are active components requiring a big size external power supply, for instance a large set of batteries.

Systems based on magnetic sensors are also known, however they do not offer a sufficient accuracy of measurement.

For these reasons, there exist the need by the industry of a technically and economically viable system for permanently and continuously monitoring current distribution in all electrodes installed in an electrowinning or electrorefining plant.

SUMMARY OF THE INVENTION

The present invention allows monitoring in continuous the current distribution of thousands of electrodes in electrochemical plants, for instance in metal electrowinning or electrorefining plants, without using externally powered active components and without requiring operators to carry out manual measurements in unhealthy environments, by reporting the malfunctioning of one or more specific electrodes through an alerting system.

The invention additionally allows cutting off the electrical current between the bus-bar and an individual electrode through electrical contact removal means.

The absence of active electronic components such as infrared or magnetic sensors provides a much cheaper and virtually maintenance-free system.

Various aspects of the invention are set out in the accompanying claims.

Under one aspect, the invention relates to a current collecting bus-bar for electrochemical cells, for instance cells suitable for electrometallurgy plants, consisting of an elongated main body having a homogeneous resistivity, comprising housings for one or more optionally removable anode and/or cathode electrical contacts evenly spaced apart, the current collecting bus-bar further comprising probes for detecting electric potential connected to the bus-bar by securing means in correspondence of the electrical contacts established between the bus-bar and the electrodes housed thereupon.

The term housings is used herein to indicate appropriate seats suitable for accommodating and supporting anodes and cathodes, as well as favouring optimum and optionally removable electrical contacts between the electrodes and the bus-bar.

The inventors observed that by selecting suitable materials for current collecting bus-bars characterised by constant resistivity in all directions, well defined geometries of electrode housings provided on the bus-bars and suitable electrical contacts between bus-bars and electrodes, the electric current apportionment to the electrodes can be put in direct correspondence with potential difference values that can be measured on the current collecting bus-bars.

In one embodiment, the current collecting bus-bar is provided with housings of one or more optionally removable anodic and cathodic electrical contacts arranged to be evenly spaced apart alternately in the longitudinal direction.

In a further embodiment, the current collecting bus-bar is provided with housings of one or more optionally removable anodic and cathodic electrical contacts arranged to be evenly spaced apart in the longitudinal direction on opposite sides of the bus-bar width.

It was also observed that in an ideal system of apportionment of homogeneous amount of current among all electrodes, the potential difference results constant for each pair of adjacent electrodes.

In the context of the present specification, the term housings having removable electrical contacts is used to mean appropriate seats suitable for housing electrodes (anodes or cathodes) coupled with means for disconnecting the electrical contacts between the electrode and the bus-bar, such as devices comprising springs.

Current collecting bus-bars may be manufactured according to different shapes with the housings located at equal distance along the bus-bar length; in one embodiment, bus-bars may have sufficient width to allow placing the housings alternatively on the two opposite sides along the length of the bus-bar.

Under another aspect, the invention relates to a plant comprising a multiplicity of electrolysis cells mutually connected in electrical series by means of current collecting bus-bars comprising housings of one or more optionally removable anodic and cathodic electrical contacts. The bus-bars further comprise probes for detecting the electric potential connected thereto by securing means in correspondence of the optionally removable electrical contacts.

Under a further aspect the invention relates to a system for continuously monitoring the current distribution in each electrode of electrolytic cells as hereinbefore described comprising current collecting bus-bars having housings of one or more optionally removable anodic and/or cathodic electrical contacts comprising probes for detecting the electric potential connected to the current collecting bus-bars by securing means; an analogue or digital data computation system allowing to obtain current intensity values in each individual cathode or anode connected to an alert device; further comprising a processor suitable for comparing the current intensity measurement provided by the computation system to a set of predefined critical values for each anode and cathode and for actuating the alert device whenever the calculated current intensity results non compliant to said corresponding predefined critical value for any anode or cathode.

Under yet another aspect, the invention relates to a system for continuously monitoring the current distribution in each electrode of electrolytic cells as hereinbefore described comprising current collecting bus-bars having housings of one or more removable anodic and/or cathodic electrical contacts comprising probes for detecting the electric potential connected to the current collecting bus-bars by securing means; an analogue or digital data computation system allowing to obtain current intensity values in each individual cathode or anode connected to a remotely commanded device for lifting individual electrodes, optionally provided with one or more springs; further comprising a processor suitable for comparing the current intensity measurement provided by the computation system to a set of predefined critical values for each anode and cathode and for actuating the lifting device whenever the calculated current intensity results non compliant to said corresponding predefined critical value for any anode or cathode, thereby disconnecting the individual non-compliant anode or cathode.

In accordance with various embodiments, the securing means of the probes to the current collecting bus-bars can be selected between bolting and welding; the probes can consist of cables or wires.

The invention can also be practised in the case of electrolytic cells having electrodes fed from one side and leaning on an additional bus-bar on the other. Said additional bus-bar, usually referred to as compensation bus-bars, are independent for anodes and for cathodes.

Some embodiments of bus-bars according to the invention are described in the following with reference to the attached drawings, which have the mere purpose of illustrating the mutual arrangement of the different elements in particular embodiments of the invention; in particular, the drawings shall not be intended to be reproductions in scale.

DETAILED DESCRIPTION OF THE DRAWINGS

Figure 1:
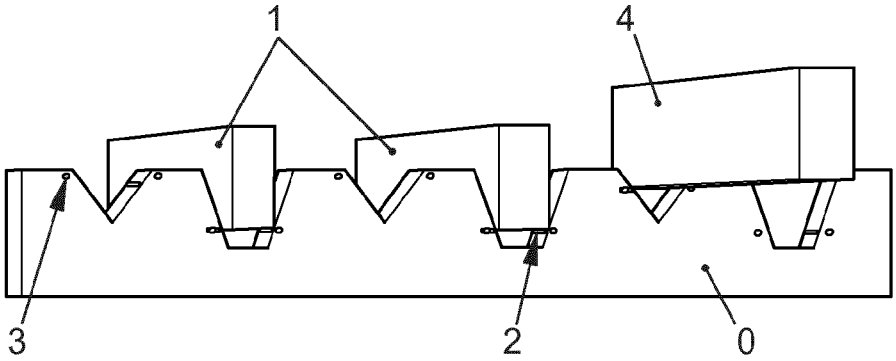
FIGS. 1 and 2 show a three-dimensional sketch of three possible embodiments of the invention comprising a current collecting bus-bar, anodes, cathodes, electrode/bus-bar contact zones, detection points associated with the contacts.

In FIG. 1 there is shown a current collecting bus-bar with variable geometry profile 0, anodes 1, electrode/bus-bar electrical contact zones 2, detection points 3 associated with the electrical contacts, cathode 4.

Figure 2:
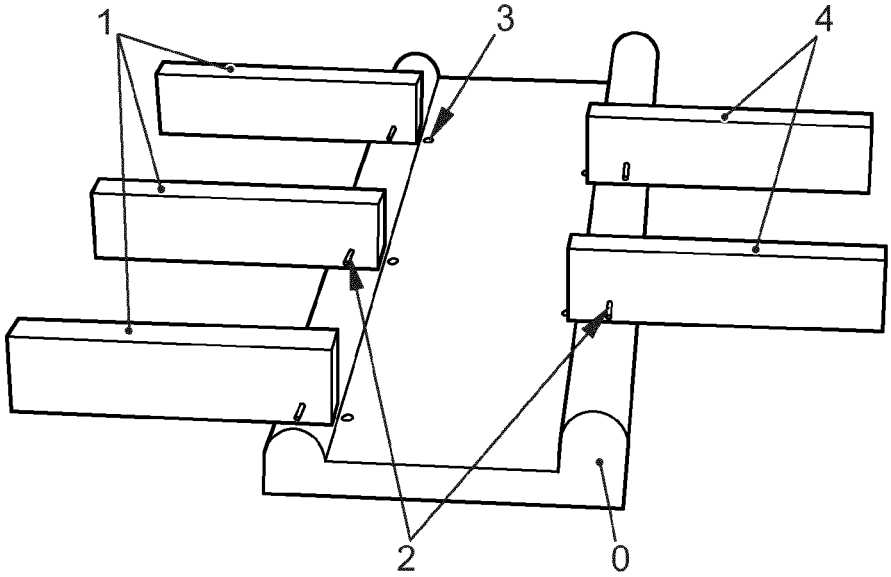

In FIG. 2 there is shown a current collecting bus-bar 0, anodes 1, electrode/bus-bar electrical contact zones 2, detection points 3 associated with the electrical contacts, cathodes 4.

Figure 3:
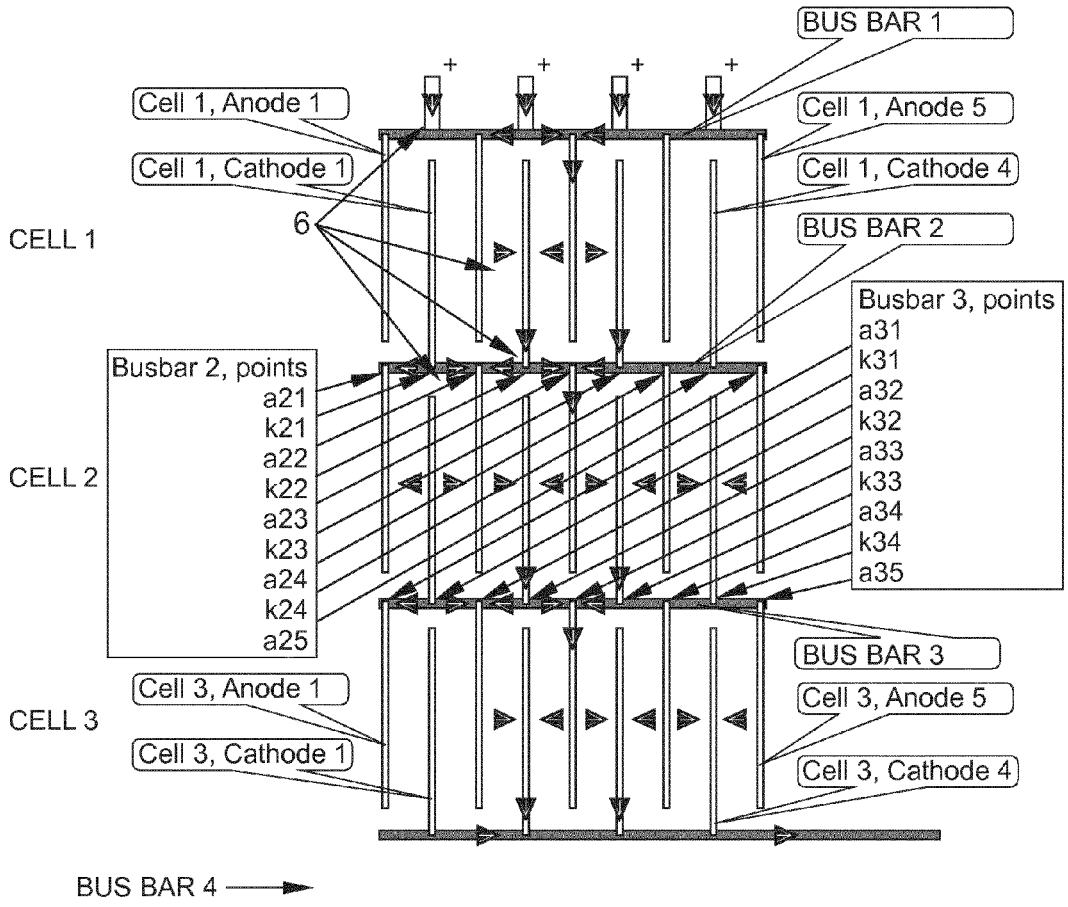
FIG. 3 shows a scheme of a plant comprised of 3 electrolytic cells connected in series, each cell comprising 5 anodes and 4 cathodes.

In FIG. 3 there is shown a scheme of electrolysis plant comprised of 3 electrolytic cells (Cell 1, Cell 2 and Cell 3) connected in electrical series, each comprising 5 anodes (Anode 1, Anode 2, Anode 3, Anode 4 and Anode 5), 4 cathodes (Cathode 1, Cathode 2, Cathode 3 and Cathode 4), an anodic current collecting bus-bar (BUS BAR 1), a cathodic current collecting bus-bar (BUS BAR 4), two bipolar current collecting bus-bars (BUS BAR 2 and BUS BAR 3), arrows indicating the direction of current 6, potential detection points ($a_{21-25}$, $k_{21-24}$, $a_{31-35}$, $k_{31-34}$).

Figure 4:
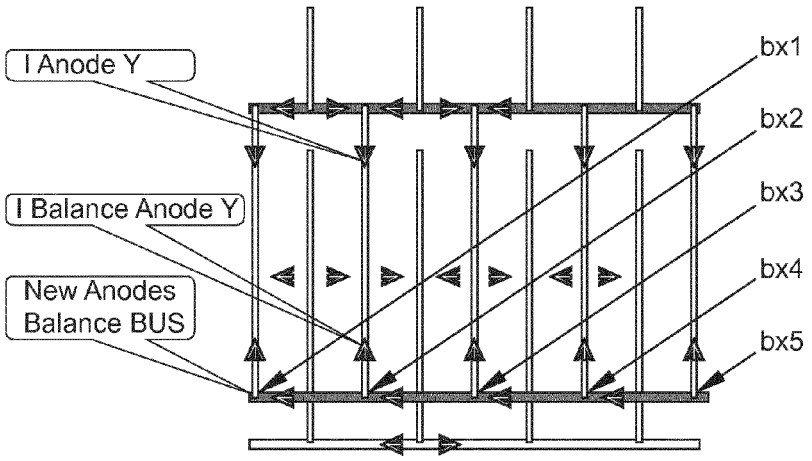
FIG. 4 shows a scheme comprising a compensation bus-bar.

In FIG. 4 there is shown a scheme of cell comprising a compensation bus-bar (New Anodes Balance BUS), arrows indicating the direction of the main current (I Anode Y), arrows indicating the direction of the compensation current (I BalanceAnode Y).

Figure 5A:
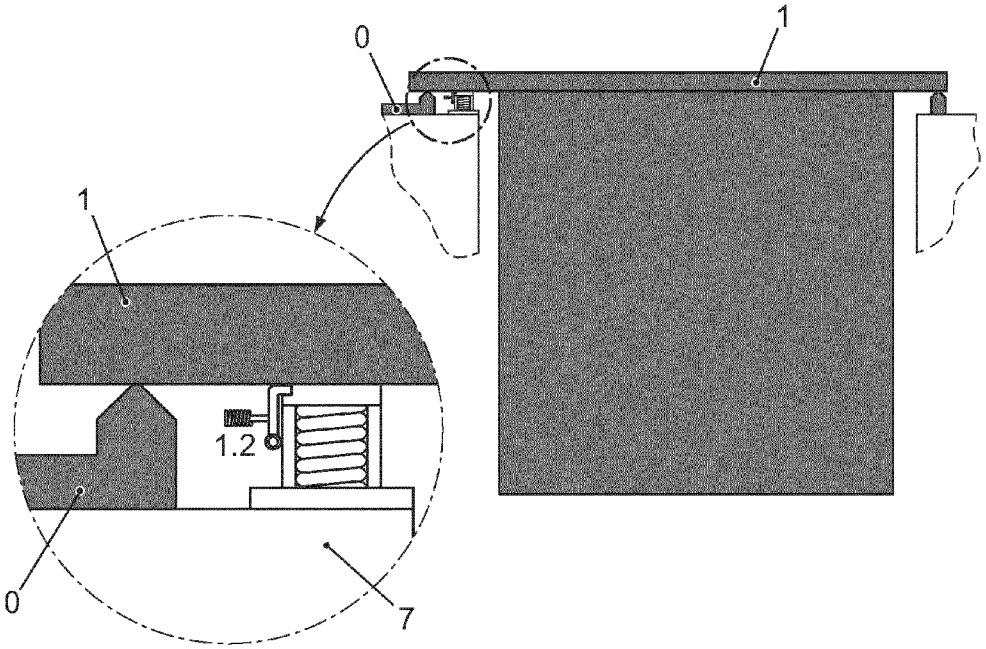
FIG. 5 shows the front-view of an electrode in the presence of an electrical contact with the current collecting bus-bar, with relevant detail (5*a*) and an electrode in the absence of electrical contact, with relevant detail (5*b*).
Figure 5B:
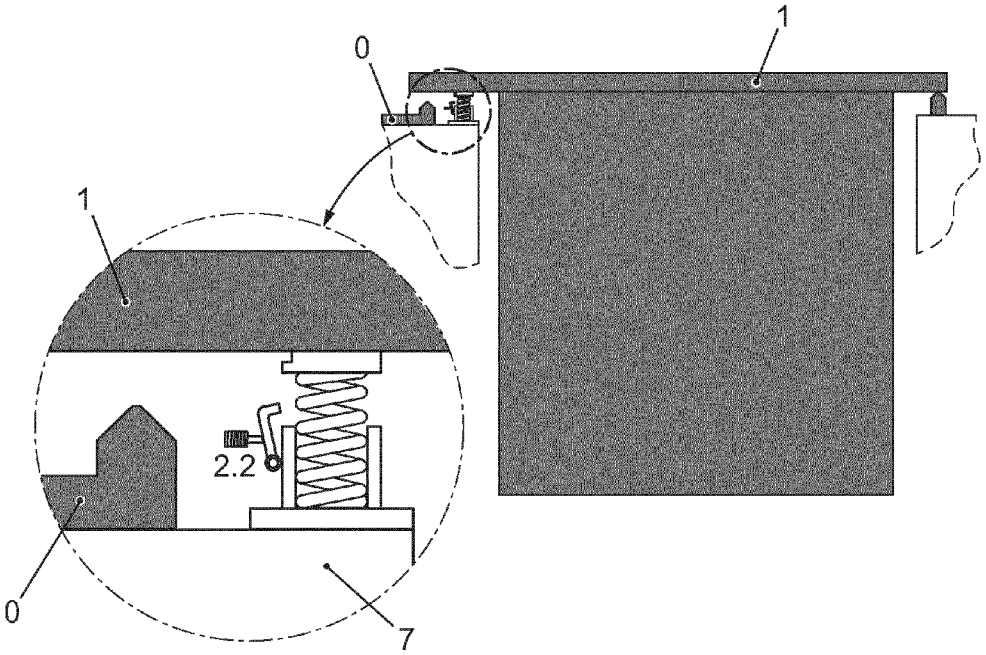

FIG. 5 shows a front view comprising a bus-bar 0, an electrode 1 in electrical contact therewith, means for disconnecting the electrical contacts 7 as well as a detail of the contact zone in the presence of an electrical contact (5*a*) and a detail of the same in the absence of electrical contact (5*b*).

Some of the most significant results obtained by the inventors are presented in the following example, which is not intended as a limitation of the extent of the invention.

EXAMPLE

A plant for copper electrowinning was assembled according to the scheme of FIG. 3. Three electrolysis cells, each comprising 5 anodes made of a titanium mesh coated with an iridium oxide-based catalytic layer and 4 copper cathodes, were connected in electrical series by way of two copper current collecting bus-bars with trapezoidal-shaped seats for the anodes and triangular-shaped seat for the cathodes (see FIG. 1). 36 cables were then connected by bolting to the bus-bars in correspondence of the 36 electrical contacts that were generated (two per electrode). The cables were then connected in their turn to a data logger equipped with microprocessor and data memory, programmed to actuate an alert connected thereto whenever a discrepancy of 10% with respect to the preset data were detected.

The method employed for calculating the apportionment of current in this specific case is based on the model expressed by the following formulas with current I relative to each anode and each cathode of cell 2 given by:

I (anode 1)=$I'(k_{21}, a_{21})$

I (anode 2)=$I''(k_{21}, a_{22})+I'(k_{22}, a_{22})$

I (anode 3)=$I''(k_{22}, a_{23})+I'(k_{23}, a_{23})$

I (anode 4)=$I''(k_{23}, a_{24})+I'(k_{24}, a_{24})$

I (anode 5)=$I''(k_{24}, a_{25})$

I (cathode 1)=$I'(k_{31}, a_{31})+I''(k_{31}, a_{32})$

I (cathode 2)=$I'(k_{32}, a_{32})+I''(k_{32}, a_{33})$

I (cathode 3)=$I'(k_{33}, a_{33})+I''(k_{33}, a_{34})$

I (cathode 4)=$I'(k_{34}, a_{34})+I''(k_{34}, a_{35})$ wherein I' and I" identify currents flowing across fractions of current collecting bus-bars comprised between each couple of electrical contacts bridging each cathode and each anode.

For a generic cell X the following relationships then apply:

I (anode Y)=$I''[k_{X(Y-1)}, a_{XY}]+I'(k_{XY}, a_{XY})$

I (cathode Y)=$I'[k_{(X+1)Y}, a_{(X+1)Y}]+I''[k_{(X+1)Y}, a_{(Y+1)(Y+1)}]$

Due to the material homogeneity and the current collecting bus-bar configuration, the value of resistance R between two consecutive electrical contacts of a bus-bar is the same.

Being V the potential difference between two generic consecutive electrical contacts, then the relevant current is equal to 1/(R×V).

If $I_{tot}$ is the total current and N cathodes and N+1 anodes per cell are present, then for a generic cell the following applies:

$I_{tot}=\Sigma I$(anode Y) with Y ranging from 1 to N+1 or $I_{tot}=\Sigma I$ (cathode Y) with Y ranging from 1 to N+1.

Throughout all cells: $I_{tot}=(1/R)\times\{\Sigma V[k_{X(Y-1)}, a_{XY}]+V(k_{XY}, a_{XY})\}$ with Y ranging from 1 to N+1, so that in each cell: $1/R=I_{tot}/\{\Sigma V[k_{X(Y-1)}, a_{XY}]+V(k_{XY}, a_{XY})\}$ with Y ranging from 1 to N+1.

The same evaluation of 1/R can be carried out starting from the cathode currents in one cell.

Such operation is performed for all current collecting bus-bars.

In particular, for the single anode and the single cathode of a generic cell X the following applies:

I (anode Y)=$1/R\times\{V[(k_{X(Y-1)}, a_{XY})]+V(k_{XY}, a_{XY})\}$

I (cathode Y)=$1/R\times\{V[k_{(X+1)Y}, a_{(X+1)Y}]+V[k_{(X+1)Y}, a_{(Y+1)(Y+1)}]\}$ A person skilled in the art may use other models, such as the case where compensation bus-bars are present.

In such case, with reference to FIG. 4, if I(Banode Y) is the current received by anodes of the compensation bus-bar with anodes leaning on the opposite side and $b_X$ are the contact points between compensation bus-bar and anodes, the following applies:

I(Banode Y)=$I[b_{X(Y+1)}, b_{XY}]-I[b_{XY}, b_{X(Y-1)}]$

Indicating then with $R_b$ the resistance of the portion of compensation bus-bar interposed between two adjacent electrical contacts, the following relationship is obtained:

I(Banode Y)=$1/R_b*\{V[b_{X(Y+1)}, b_{XY}]-V[b_{XY}, b_{X(Y-1)}]\}$, and the total current to the anodes will be:

I(total current anode Y)=((anode Y)+I(Banode Y).

The previous description shall not be intended as limiting the invention, which may be used according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements, components or additional process steps.

The invention claimed is:

1. Current collecting bus-bar for cells of electrochemical plants comprising:

an elongated main body having homogeneous resistivity, said body comprising housings for one or more optionally removable anode and/or cathode electrical contacts, said housings being evenly spaced apart;

probes for detecting electric potential, said probes being connected by securing means to said current collecting bus-bar in correspondence of said one or more electrical contacts.

2. Current collecting bus-bar according to claim 1, wherein said housings for one or more optionally removable anode and cathode electrical contacts are positioned alternately in the longitudinal direction and evenly spaced apart.

3. Current collecting bus-bar according to claim 1, wherein said housings for one or more optionally removable anode and cathode electrical contacts are evenly spaced apart in the longitudinal direction and positioned on opposite sides of the bus-bar width.

4. Electrochemical plant comprising a multiplicity of electrolysis cells, said cells being mutually connected in electrical series by means of current collecting bus-bars according to claim 1.

5. Plant according to claim 4, wherein said multiplicity of cells is connected in electrical series:

to an anodic terminal cell connected to the positive pole of a rectifier by means of a current collecting bus-bar having housings for one or more anode electrical contacts; and to a cathodic terminal cell connected to the negative pole of a rectifier by means of a current collecting bus-bar having housings for one or more cathode electrical contacts;

said current collecting bus-bars having probes for detecting electric potential connected by securing means to said current collecting bus-bars in correspondence of said one or more electrical contacts.

6. Current collecting bus-bar according to claim 1 wherein said securing means are selected between bolting and welding.

7. Current collecting bus-bar according to claim 1 wherein said probes for detecting electric potential are cables or wires.

8. System for continuously monitoring current distribution in each electrode of electrolytic cells of electrochemical plants comprising:

current collecting bus-bars with housings for one or more optionally removable anode and/or cathode electrical contacts, said bus-bars comprising probes for detecting electric potential connected by securing means to said bus-bars;

analogue or digital computational means for measuring current intensity values in each individual electrode starting from the electric potential values detected by said probes;

an alert device connected to each electrode;

a processor suitable for comparing the current intensity measurement provided by said computational means to a set of predefined critical values for each electrode;

means for actuating said alert device whenever said current intensity results not compliant to said corresponding predefined critical value for any electrode.

9. System for continuously monitoring current distribution in each electrode of electrolytic cells of electrochemical plants according to claim 8 comprising:

an alerting device connected to all electrodes;

means for actuating said alerting device whenever said current intensity results not compliant to said corresponding predefined critical value for any electrode.

10. System for continuously monitoring current distribution in each electrode of electrolytic cells of electrochemical plants according to claim 8 comprising:

devices for lifting individual electrodes;

means for actuating said lifting devices whenever said current intensity results not compliant to said corresponding predefined critical value for any individual electrode.

11. System for continuously monitoring current distribution in each electrode of electrolytic cells of electrochemical plants according to claim 10 wherein said lifting devices comprise at least one spring.

* * * * *